United States Patent [19]

Garland

[11] 3,986,801

[45] Oct. 19, 1976

[54] SCREW COMPRESSOR

[75] Inventor: Milton W. Garland, Waynesboro, Pa.

[73] Assignee: Frick Company, Waynesboro, Pa.

[22] Filed: May 6, 1975

[21] Appl. No.: 574,982

[52] U.S. Cl. ..... 418/99; 418/150; 418/201

[51] Int. Cl.[2] ..... F04C 17/12; F04C 29/02

[58] Field of Search ..... 418/201, 202, 203, 150, 418/99

[56] References Cited

UNITED STATES PATENTS

| | | | |
|---|---|---|---|
| 1,409,868 | 3/1922 | Kien | 418/201 X |
| 3,088,658 | 5/1963 | Wagenius | 418/201 |
| 3,874,828 | 4/1975 | Herschler et al. | 418/201 X |

FOREIGN PATENTS OR APPLICATIONS

| | | | |
|---|---|---|---|
| 890,088 | 1/1944 | France | 418/201 |

*Primary Examiner*—C. J. Husar
*Assistant Examiner*—Leonard Smith
*Attorney, Agent, or Firm*—A. Yates Dowell, Jr.

[57] ABSTRACT

A screw compressor apparatus in which the rotors have equal pitch circle diameters, and addendum and dedendum of equal radius.

6 Claims, 6 Drawing Figures

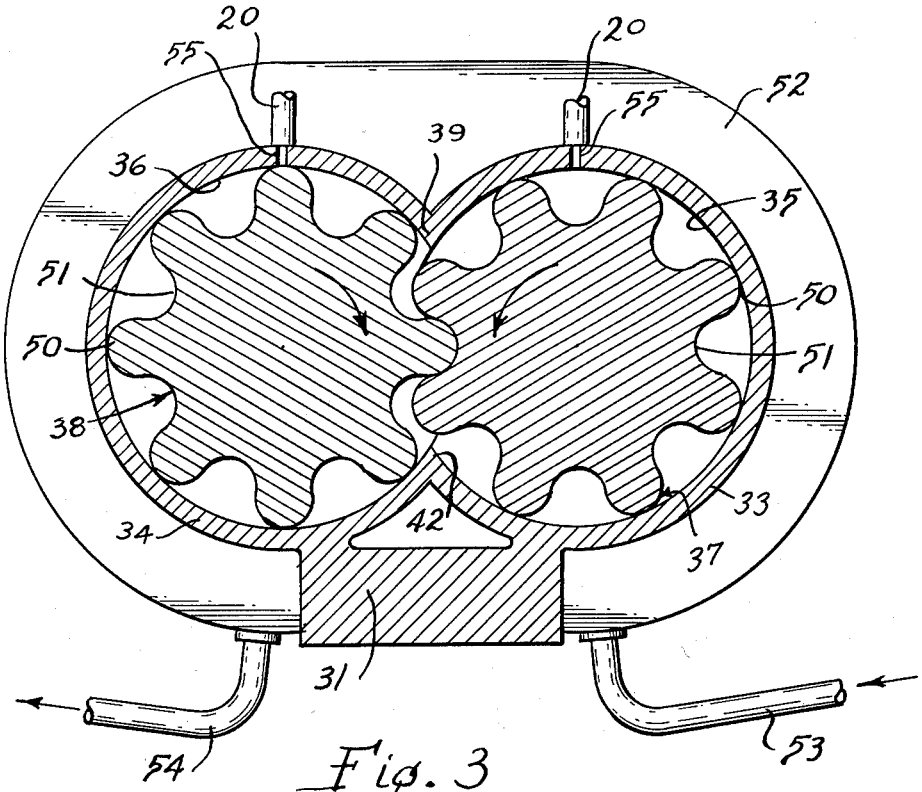
Fig. 3
Fig. 4
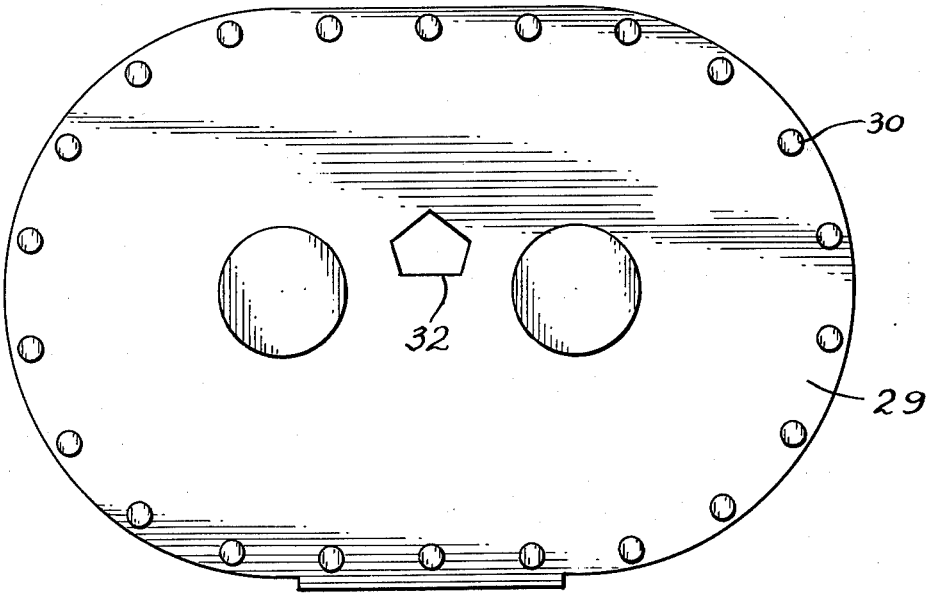

PC
50
51
C'
38
R
CD
PCD
T
C
R
R
PC
T
C
C'
37
PCD
50
51
R
T
R 27
57
29'
45
47
12
29
49
45'
38
27
37
26
28'
46
44
28
45'
48
50
26

SCREW COMPRESSOR

BACKGROUND OF THE INVENTION 1. Field of the Invention

This invention relates generally to positive displacement rotary compressors and pumps and specifically to screw compressors and pumps having rotors with identical pitch circle diameters and in which the lands and grooves of each rotor are of equal radius and are uniformly spaced and centered along the pitch circle.

2. Description of the Prior Art

From the earlier "Roots" type blowers to the more currently developed oil injection screw compressors, there has been considerable effort directed to refining and developing rotary pumps and compressors to achieve increased operating efficiency, reduce costs, and improve production techniques.

Prior to the introduction of the oil injected screw threaded compressors, it was necessary to manufacture the compressor rotors in such a manner as to provide sufficient clearance between rotor parts to reduce friction wear and allow for the heating effects on the mating components. Such clearance space required the rotors to be run at a greater rate to compensate for the lost compression efficiency of the system.

With the introduction of oil injection into screw compressors, not only was it possible to increase the compressor tolerances by providing lubrication to ease friction wear and cool the compressor components, but the oil increased efficiency by reducing the necessary clearance between the mating compressor rotors.

In an effort to further simplify the design of the screw compressor, a system or method of a single rotor drive was developed. In this type of operation, one rotor is driven solely by its engagement with another rotor which is connected to the compressor drive or motor. This system obviated the need for rotor timing gears or chains and resulted in even closer tolerances between the mating parts of the compressor rotors and thereby improved compressor efficiency.

Some examples of the prior art are U.S. Pat. Nos. 2,623,469 to Gray; 1,409,868 and 1,439,628 to Kier; 2,460,310 to Rathman; 30,159 and Re. 2,369 to Roots; and 2,622,787 to Nilsson.

SUMMARY OF THE INVENTION

This invention is embodied in a rotary device of the screw compressor type in which the rotors are formed having equal pitch circle diameters and in which the lands and grooves are characterized by equal radii which extend from the respective centers of the lands and grooves that are located in equally spaced relationship along the pitch circle of the rotors. The radial dimension of the lands and grooves is specifically determined to cause the point of tangency between the land and an adjacent groove to be located within the pitch circle of the rotors.

It is an object of this invention to provide a rotary device of the screw compressor type in which a minimum of leakage space is developed between the lobe of one rotor and the valley of the meshing adjacent rotor during compression.

It is a further object of this invention to provide a screw compressor in which oil is injected into each rotor of the compressor adjacent the area of compression to effectively seal the leakage space between the rotors during compression.

It is another object of this invention to provide a screw compressor device in which the lands and grooves of the rotors may be easily formed by standard cutting procedures.

It is a further object of this invention to provide screw type compressors having a fluid inlet which permits the fluid to be compressed to be introduced directly over substantially the entire length of the rotors thereby filling the rotor pockets prior to compression.

BRIEF DESCRIPTION OF THE DRAWINGS

FIG. 3 is a section taken through line 3—3 of FIG. 2.

FIG. 4 is an end view of the compressor.

DESCRIPTION OF THE PREFERRED EMBODIMENT

Figure 1:
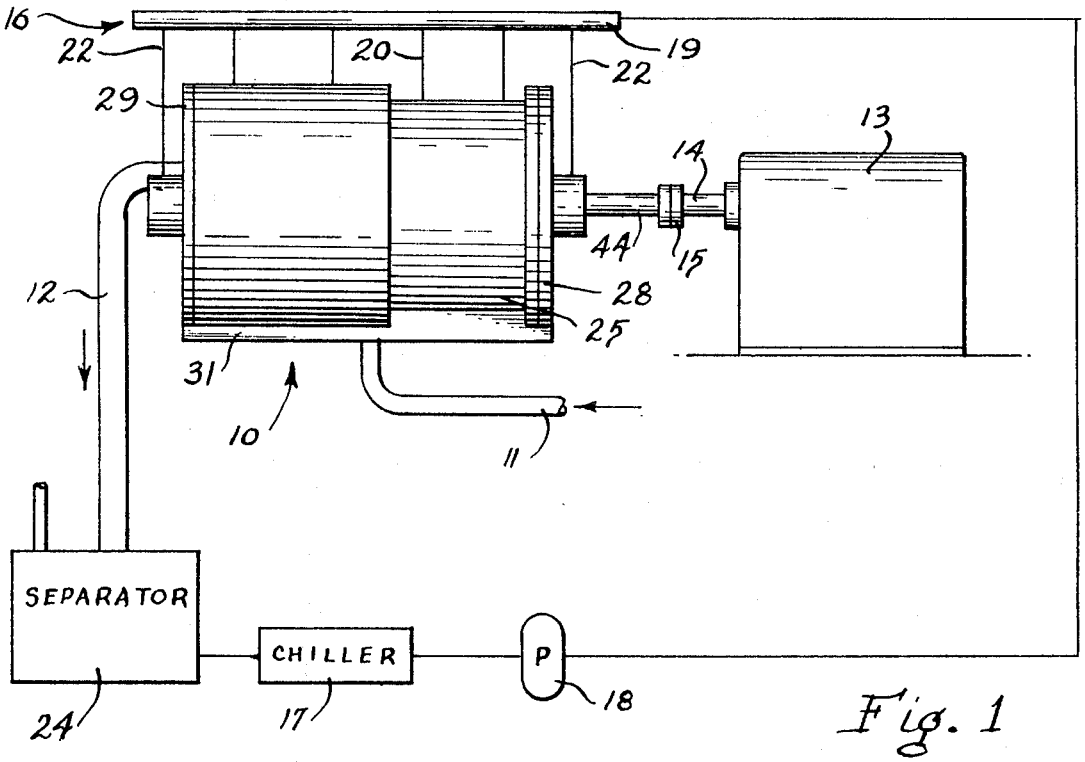
FIG. 1 is a side elevation illustrating one embodiment of the compressor.
Figure 2:
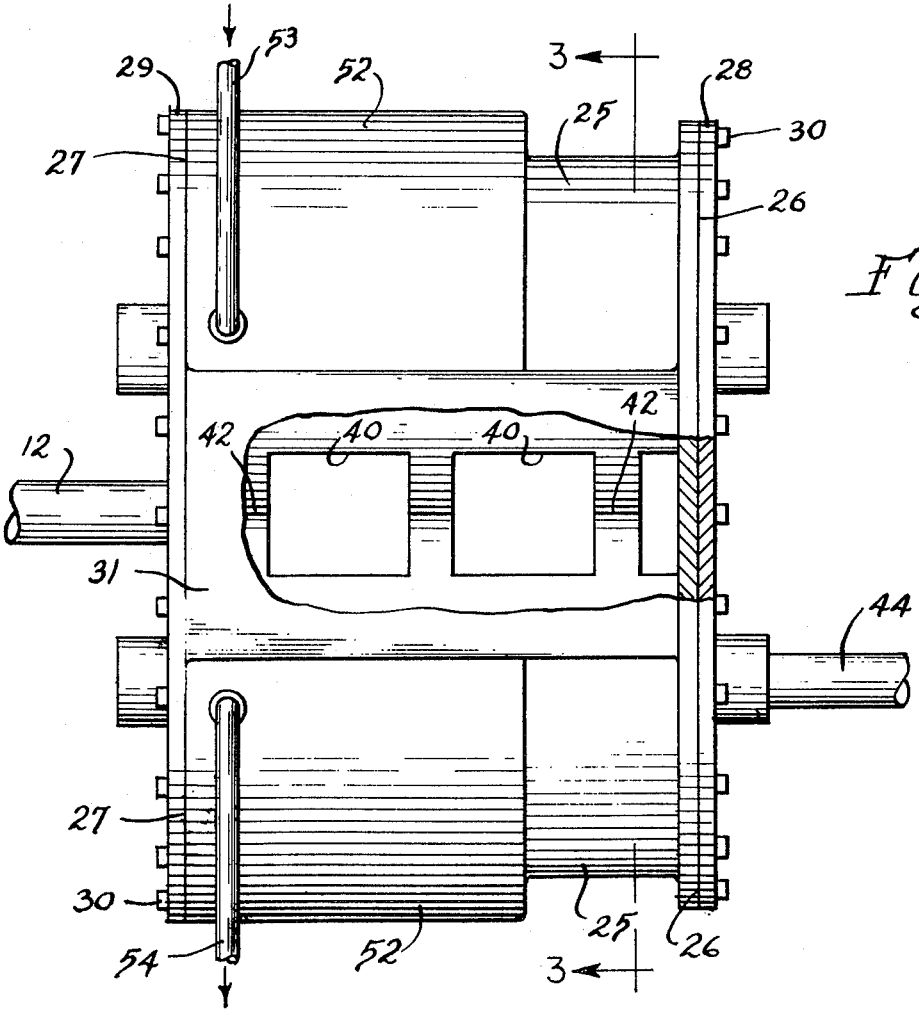
FIG. 2 is a bottom plan view of the compressor with portions broken away for clarity.

With continued reference to the drawings, a compressor 10 is shown in FIG. 1, connected to a fluid inlet pipe 11 and a fluid outlet pipe 12. It should be noted that although the preferred embodiment of this invention is embodied in a compressor, it would also be equally adaptable for use in a fluid pump.

The compressor 10 is powered by a motor 13 through a drive shaft 14 and a drive clutch or shaft coupling 15. An oil injection system 16 is provided, as shown in FIG. 1, to supply oil to the compressor 10 for reasons which will be discussed in the following paragraphs. The oil injection system includes an oil chiller 17 from which cool oil is conveyed by a pump 18 to an oil distribution header 19. Oil from the distribution header is introduced into the compressor through a plurality of oil supply lines 20. A second set of oil supply lines 22 are also shown as extending from opposite ends of the distribution header 19 to a point adjacent both ends of the compressor.

The oil which has been injected into the compressor through the supply lines 20 is eventually exhausted from the compressor along with the compressed working fluid. In order to recover this entrained oil, an oil separating chamber 24 is provided along a portion of the outlet pipe 12. The oil separated in chamber 24 is subsequently recycled through the oil chiller and pumped back to the compressor.

The compressor 10 has an elongated housing 25 which is generally horizontally disposed, although this may vary depending upon the particular use of the compressor. The end surfaces 26 and 27 of the housing 25 provide surfaces for seating the end covers or walls 28 and 29. The end walls are tightly secured to the end surfaces by a plurality of bolts 30 or other appropriate fastening elements. A fluid inlet or suction port or header 31 through which the working fluid is introduced from the inlet pipe 11 into the compressor is disposed generally centrally of the housing and extends substantially the entire length thereof. A fluid outlet or exhaust port 32 extends through the end cover 29 and through which compressed fluid is discharged from the compressor into the exhaust line 12 to the oil separator 24.

The compressor housing 25 is formed of two arcuately shaped chamber walls 33 and 34, which are in side-by-side abutting relationship and thereby define two adjoining rotor chambers or bores 35 and 36 wherein a pair of rotors 37 and 38 are maintained in meshed relationship with one another. Rotor 37 functions as a drive rotor receiving power from the motor 13 through the drive shaft 14 and the clutch or shaft connection 15. Rotor 38, however, functions as a driven rotor being rotated by the meshed engagement with drive rotor 37. The upper edges of the arcuate rotor chamber walls are integrally connected and form an elongated downwardly projecting cusp 39.

In order to permit the fluid entering the compressor through the suction header 31 to pass into the rotor chambers 35 and 36, a plurality of inlet openings 40 of substantially constant width are provided along the length of and between the lower edges of the rotor chamber walls. Fluid entering the compressor through the inlet pipe 11 is directed to the inlet openings 40 by the header 31. In this manner fluid is permitted to fill the header so that the flow of fluid therefrom into the rotor chambers will be direct and along the full length of the rotors. The compressor walls adjacent the openings 40 are reinforced by a plurality of upwardly or inwardly projecting cusps 42 which are formed by abutting extensions of the lower portions of the rotor walls 35 and 36.

Each of the rotors 37 and 38 extends between the inner surfaces 28' and 29' of the end covers 28 and 29, and the drive rotor 37 has a reduced drive shaft 44 at one end and a stub shaft 45 at the opposite end while the driven rotor 38 has a reduced stub shaft 45' at each end. The drive shaft 44 of the drive rotor 37 is rotatably mounted within a bearing 46 in the end cover 28 and is connected to the clutch or shaft connection 15 in a manner to be driven by the drive motor 13 while the stub shaft 45 at the opposite end is rotatably mounted in an enclosed bearing 47 in the end cover 29. The stub shafts 45' of the driven rotor 38 are rotatably mounted within enclosed rotor bearings 48 and 49 which are provided in the end covers 28 and 29.

Each of the generally cylindrical rotors is defined by an outer surface comprising a plurality of lands 50 and grooves 51 which are helically wrapped around the rotor from end to end. The configuration of the rotors is such that the outermost cylindrical dimension thereof, which is defined by the upper or outermost portion of the lands is in substantially sliding engagement with the cylindrical bore of the rotor chambers and with the slight space therebetween being sealed by a film of oil from the oil injection system 16. Further, the ends of the rotors extend generally perpendicular to the axis of the rotor chambers so as to be substantially in sliding engagement with the respective inner surfaces 28' and 29' of the end covers.

In order to aid in alleviating the problem associated with the heat build-up adjacent the end wall 29 during compression, a cooling jacket 52 having liquid inlet 53 and outlet 54 is disposed around a portion of the central housing of the compressor. The jacket permits water or other cooling fluid to flow in heat exchange relationship with the housing and thereby aid in dissipating heat which might otherwise adversely affect the operation of the compressor.

The rotors 37 and 38 are designed with pitch circles PC having equal diameters PCD and similar addendum and dedendum; however, the lands and grooves of rotor 38 extend in a lefthand pitch angle or wrap around the central axis of the rotor while the lands and grooves of rotor 37 extend in a righthand pitch angle or wrap around that rotor.

Figure 5:
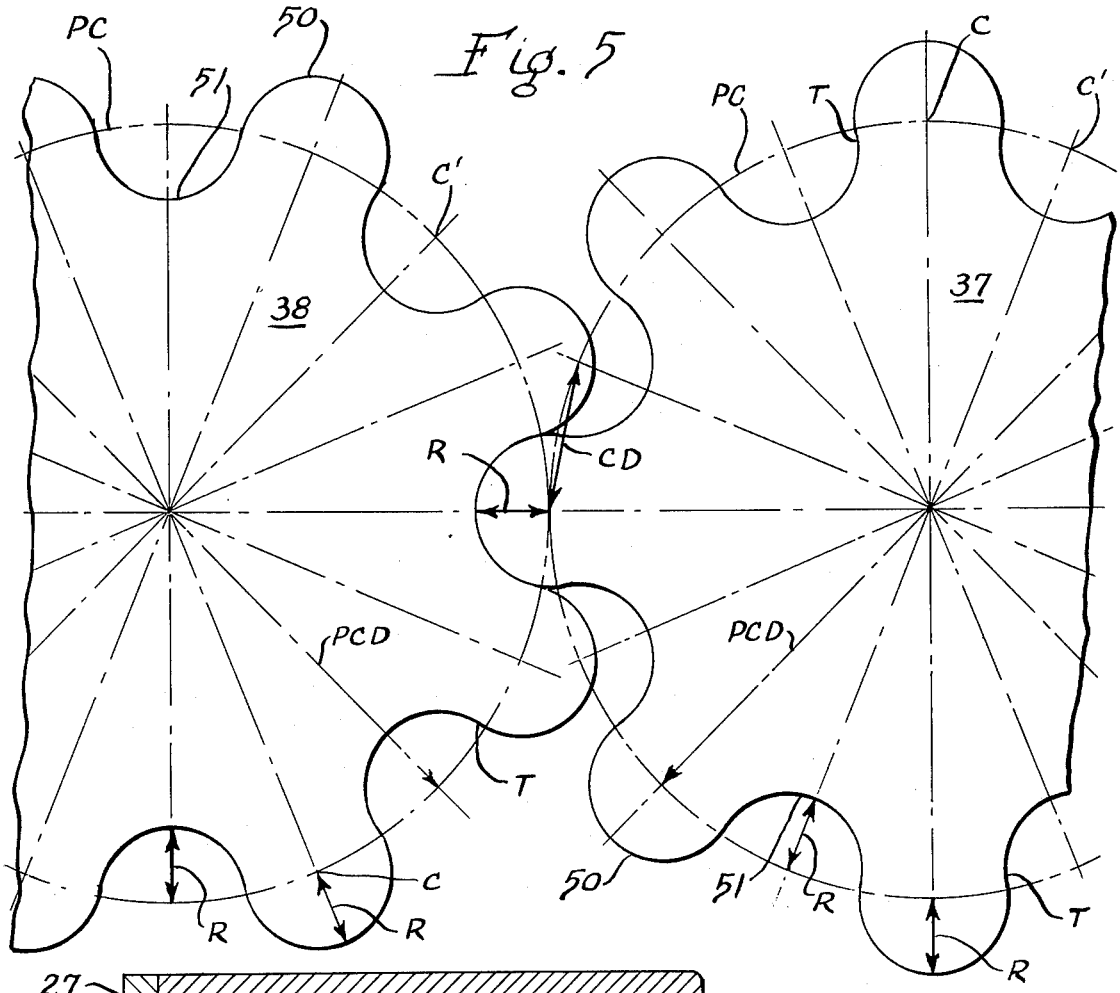
FIG. 5 is an enlarged fragmentary cross-section illustration of the compressor rotors taken normal to the longitudinal axes of the rotors.

A cross-section of the rotors is shown in FIGS. 3 and 5. As is shown in the drawings, the lands or teeth of the rotors are generally convex in appearance and are symmetrical with one another. Likewise the grooves, valleys, or pockets which are formed between the lands are symmetrical with each other as well as with the lands although they are concave in appearance. Further, although the compressor described in this preferred embodiment has rotors having eight lands and grooves, rotors having two or more such lands and grooves may be effectively used as desired.

Each land and groove has a radius R. Therefore, the radii of the lands and grooves are equal. The centers C and C' of each of the lands and grooves, respectively, are located on the pitch circle of the rotor and are the points from which the respective radii are measured. It should be noted that the distance from the longitudinal axis of rotor 37 to the longitudinal axis of rotor 38, when mounted in their respective bearings, is substantially equal to the diameter of the pitch circle of the rotors with a slight increase of normally less than a hundredth of an inch being provided for running clearance.

In an effort to reduce the interference between the outer ends of the teeth or lands when the rotors are rotated and to obtain a minimum leakage space between the lands of one rotor which are meshing with the grooves of the adjacent rotor during compression, it has been determined that the radius of each of the lands and grooves should be made substantially equal in dimension to one-half of the chord distance CD between the center C of a land and the center C' of the adjacent groove. Such a dimension will locate the point of tangency T between a land and the adjacent groove within the pitch circle of the rotor.

Unlike the rotors of various other screw type compressors, the rotors of the above design require no extra cutting or rounding of the teeth or lands to prevent interference. Also, the duplicate rotors cause the compression path to alternate between the rotors as is demonstrated by the relative positioning of the rotors in FIG. 3 wherein compression is occurring between a land of rotor 38 and a meshing groove of rotor 37 and subsequently in FIG. 5 wherein the compression is along the line of the groove in rotor 38 being compressed by a land of rotor 37.

Figure 6:
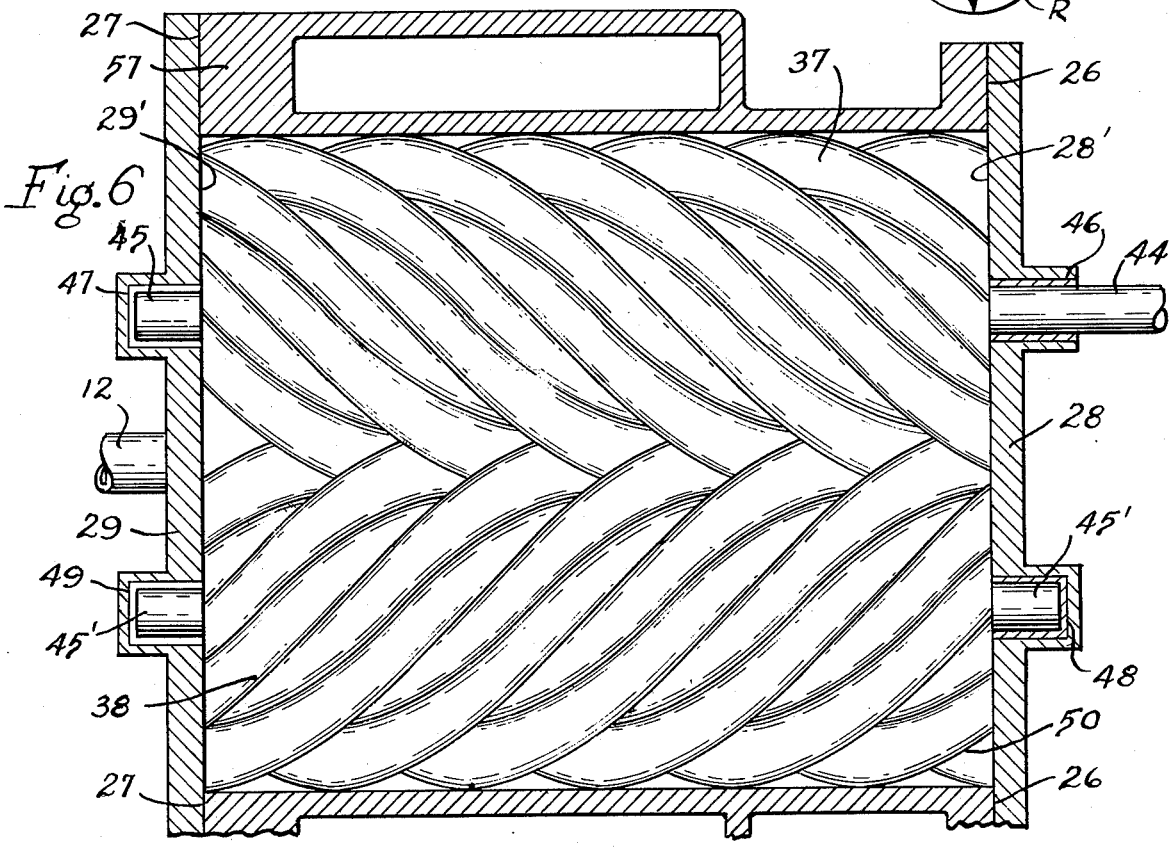
FIG. 6 is a top partial section showing the compressor rotors.

As previously stated and shown in FIG. 6, the lands and grooves of rotor 37 extend in a righthand wrap about the longitudinal axis of the rotor while the lands and grooves of rotor 38 extend in a lefthand wrap about the longitudinal axis. Although the wrap of the lands or lobes of the rotors are shown as being approximately 270°, the amount of wrap or the number of degrees through which the lands and grooves extend is dependent upon several variables. These variables include the physical characteristics of the rotors including rotor length, pitch circle diameter, and pitch angle, as well as various manufacturing considerations. The degree of wrap should be such as to allow the entire length of a rotor valley or pocket to be exposed to the inlet openings 40 which extend along the lower surface of the compressor rotor chambers and be subsequently closed therefrom before compression is initiated. Thus the wrap is such as to prevent a leakage space or opening from being established along a groove between the intake and exhaust sides of the compressor and thereby prevents what would otherwise be an excessive energy loss.

Normally the degree of wrap may vary within the range of 120° to 270°; however, when taking into account manufacturing techniques, number of teeth, and pitch, it is necessary that the wrap be not less than one-half of the linear circumference of the pitch circle divided by 360. That is, the axial linear advance of a land or groove for each degree of radial change should be at least equal to one-half of the circumference of the pitch circle divided by 360.

A further design characteristic of compressors such as this wherein it is desired to drive one rotor with the other, is that the pitch angle of the rotor lands or lobes should be such as to avoid excessive end thrust while allowing for minimum clearance or leakage space between the mating lobes and pockets.

As previously stated, oil is injected into the compressor via the oil injection system 16 and such oil serves a threefold function in the compressor operation. As shown in FIGS. 1 & 3, a plurality of oil inlet orifices 55 which communicate the inside of the compressor chambers with the oil inlet lines 20 are disposed through each chamber wall adjacent either side of the downwardly projecting cusp 39 to thereby permit oil to be injected after a given pocket has been filled and tooth engagement for compression has been accomplished.

As the rotors are driven in the direction indicated by the arrows, the compression of the fluid between a land of one rotor and the groove or hollow of the other is initiated adjacent the cusp 39. Because the rotors are duplicate and the compression path alternates between rotors, oil is injected on each side of the cusp and into the compression area of each rotor. The oil is injected in an amount which is not only sufficient to lubricate and cool the rotors and rotor chamber walls but which is adequate to seal the areas between the opposing rotor lands and grooves.

The oil is injected downwardly so as to descend through any leakage area along the plane of the rotor centers where the teeth are in full mesh. This is advisable because rotation tends to throw the oil centrifugally to the tips of the respective rotor teeth.

Unlike the oil injected into the rotor chambers of the compressor through the oil lines 20, the oil injected through the supply lines 22 is utilized primarily to lubricate the rotor bearings as well as to lubricate and seal the ends of the rotors 37 and 38.

In the operation of the screw compressor, the working fluid to be compressed such as a refrigerant vapor is introduced through the fluid inlet into the inlet header of the compressor. Rotor 37 is driven by the compressor motor and is rotated in the direction shown in FIG. 3. As rotor 37 is rotated, its lands and grooves mesh with the lands and grooves of rotor 38 driving it in a direction opposite that of rotor 37.

As the rotors revolve, the vapor flows from the inlet header and fills the entire length of the groove which is passing in open communication with the header. The wrap of the lands and grooves is such as to insure that the groove which has just been filled with vapor is closed off from the inlet header prior to compression. As the rotors continue to rotate, a land of one rotor will come into meshed engagement with the groove of the adjacent rotor which has just been filled with vapor and closed off from the inlet header. The engagement between the lands and grooves is initiated adjacent the upper cusp and compression is along the line of the meshed rotor groove and proceeds from the driving end of the compressor to the discharge or exhaust port end.

As the rotors of this invention are identical except for the direction of wrap and because the point of tangency between the lands and grooves of each rotor is located within the pitch circle of the rotors, the compression will be alternately along either side of the point of intersection between the pitch circles of the rotors; further such compression will be generally constant or equal in magnitude along each side due to the similar rotor characteristics.

In order to cool and lubricate the compressor and seal or close the leakage area between the rotors during compression, the oil is injected into the rotors following their engagement for compression. The oil is subsequently discharged through the exhaust port and is thereafter separated and cooled as previously discussed for recycling back to the compressor.

I claim:

1. In a rotor device having a pair of rotor means each of which includes a plurality of lands and intervening grooves in which the cross-sections of the lands and grooves taken through planes normal to the axis of rotation of the rotors are of a generally convex and concave configuration, respectively, having equal radial dimensions with their centers disposed in equally spaced relationship along the pitch circle of said rotors, the improvement comprising the radius of each of said lands and grooves being equal to one-half of the chord length taken between the center of one land and the center of the adjacent groove, whereby the point of tangency of each land with the adjacent groove is located between the pitch circle and the axis of the rotor.

2. A rotary device comprising a housing with end covers having bearing means therein, said housing including fluid inlet and outlet porting means, first and second rotor means mounted in said bearing means so that the axis of said first rotor means is substantially parallel to the axis of said second rotor means, each of said rotors having multiple lands and grooves helically wrapped along the length thereof, each of said lands having a generally convex cross-section and each of said grooves having a generally concave cross-section, the arcuate cross-sections of said lands and grooves having equal radial dimensions with their centers disposed in equally spaced relationship along the pitch circle of said rotors, the radius of said lands and grooves being equal to one-half of the chord length taken between the center of one land and the center of the adjacent groove whereby the point of tangency of each land with the adjacent groove is located between the pitch circle and the axis of the rotor, one of said rotors having a righthand wrap and the other of said rotors having a lefthand wrap, said rotors being meshed together along their length so that the distance between the axis of said first rotor means and the axis of said second rotor means is substantially equal to the diameter of the pitch circle defined by said rotors, drive means connected to one of said rotor means, and said inlet porting means being a length to extend the full length of said rotor means.

3. The structure of claim 1 in which the axial linear advance of said land and groove wraps for each radial degree of cross-section is at least equal to one-half of the circumference of the pitch circle divided by 360.

4. A rotary device comprising a housing with end cover having bearing means therein, said housing including fluid inlet and outlet porting means, first and second rotor means mounted in said bearing means so that the axis of said first rotor means is substantially parallel and in the same plane as the axis of said second rotor means, each of said rotor means having multiple lands and grooves helically wrapped along the length thereof, each of said lands having a generally convex cross-section and each of said grooves having a generally concave cross-section, the arcuate cross-sections of said lands and grooves having equal radial dimensions with their centers disposed in equally spaced relationship along the pitch circle of said rotors, the radius of said lands and grooves being equal to one-half of the chord length taken between the center of one land and the center of the adjacent groove whereby the point of tangency of each land with the adjacent groove is located between the pitch circle and the axis of the rotor, one of said rotors having a righthand wrap and the other of said rotors having a lefthand wrap, said rotors being meshed together along their length so that the distance between the axis of said first rotor means and the axis of said second rotor means is substantially equal to the diameter of the pitch circle defined by said rotor means, drive means connected to said first rotor means, said second rotor means being driven by said first rotor means, said inlet means and said outlet porting means being situated on opposite sides of said plane of said rotor means and generally parallel with the axis of said rotor means, and said inlet porting means being of a length to substantially extend the full length of said rotor means and of a width to permit the entire length of one of said grooves of each rotor means to be exposed to and subsequently isolated from said inlet porting means prior to being meshed with an opposing land.

5. The structure of claim 4 including means for injecting oil downwardly against said lands and grooves of each of said first and second rotor means, so as to introduce oil into said grooves after each respective groove has been isolated from said inlet porting means, said means for injecting oil being located along said outlet side of said plane of said rotor means.

6. The structure of claim 4 in which said inlet porting means includes inlet header means, and a plurality of inlet openings in said housing between said inlet header means and said rotor means and in which said housing strengthened between the inlet openings by a plurality of reinforcing cusps.

* * * * *

UNITED STATES PATENT OFFICE

CERTIFICATE OF CORRECTION

PATENT NO. : 3,986,801

DATED : October 19, 1976

INVENTOR(S) : Milton W. Garland

It is certified that error appears in the above-identified patent and that said Letters Patent are hereby corrected as shown below:

Column 6, line 67, "Claim 1" should read -- Claim 2 --

Signed and Sealed this

Fourteenth Day of December 1976

[SEAL]

*Attest:*

RUTH C. MASON
*Attesting Officer*

C. MARSHALL DANN
*Commissioner of Patents and Trademarks*